US005957046A

United States Patent [19]

Nakabayashi et al.

[11] Patent Number: 5,957,046

[45] Date of Patent: Sep. 28, 1999

[54] HIGH SPEED HYDRAULIC PRESS

[75] Inventors: Hideaki Nakabayashi; Hitoshi Sawamura, both of Ishikawa-ken, Japan

[73] Assignees: Komatsu Ltd.; Komatsu Industries Corporation, both of Tokyo, Japan

[21] Appl. No.: 09/051,367

[22] PCT Filed: Oct. 22, 1996

[86] PCT No.: PCT/JP96/03072

§ 371 Date: Apr. 7, 1998

§ 102(e) Date: Apr. 7, 1998

[87] PCT Pub. No.: WO97/15438

PCT Pub. Date: May 1, 1997

[30] Foreign Application Priority Data

Oct. 25, 1995 [JP] Japan ..... 7-277356

[51] Int. Cl.[6] ..... B30B 1/32

[52] U.S. Cl. ..... 100/231; 100/92; 100/269.14

[58] Field of Search ..... 100/48, 92, 214, 100/231, 269.14, 269.16, 269.17, 269.18

[56] References Cited

U.S. PATENT DOCUMENTS

| | | | |
|---|---|---|---|
| 1,016,070 | 1/1912 | Honegger | 100/269.14 |
| 1,088,002 | 2/1914 | White et al. | 100/269.14 |
| 1,955,278 | 4/1934 | Ferris et al. | 100/269.14 |
| 2,009,314 | 7/1935 | Gogan | 100/269.14 |
| 2,512,731 | 6/1950 | Adams | 100/269.14 |
| 2,516,301 | 7/1950 | Denison, Jr. | 100/231 |
| 2,557,265 | 6/1951 | Denison, Jr. | 100/269.14 |
| 2,696,779 | 12/1954 | Ernst | 100/269.14 |
| 2,779,989 | 2/1957 | Rumberger | 100/269.14 |
| 3,593,562 | 7/1971 | Williams et al. | 100/231 |
| 5,158,723 | 10/1992 | Walchhutter et al. | 100/269.14 |
| 5,526,738 | 6/1996 | Logan | 100/269.14 |

FOREIGN PATENT DOCUMENTS

| | | |
|---|---|---|
| 4-55099 | 2/1992 | Japan . |
| 6-39599 | 2/1994 | Japan . |
| 6-155089 | 6/1994 | Japan . |
| 7-3898 | 1/1995 | Japan . |
| 7-124797 | 5/1995 | Japan . |
| 7-155997 | 6/1995 | Japan . |

*Primary Examiner*—Stephen F. Gerrity
*Attorney, Agent, or Firm*—Frishauf, Holtz, Goodman, Langer & Chick, P.C.

[57] ABSTRACT

There is disclosed a high speed hydraulic press, having a press machine body (1) that is constructed of a C-shaped frame **(1*a*), a high speed operable hydraulic cylinder assembly (3) with a portion of hydraulic cylinder disposed in an upper part of the press machine body, and a slide (6) that is coupled to the hydraulic cylinder assembly and adapted to be moved thereby vertically up and down, the press comprising: a manifold block (4) having a passage therein and mounted to the hydraulic cylinder assembly directly on a front surface of the cylinder; and a control valve unit (8)** that is associated with the manifold block for delivering a pressure fluid into the hydraulic cylinder via the passage in the manifold block while controlling at least one of parameters of the pressure fluid including flow rate and pressure thereof.

6 Claims, 7 Drawing Sheets

HIGH SPEED HYDRAULIC PRESS

TECHNICAL FIELD

The present invention relates to a high speed hydraulic press and, more particularly, to a pressing machine that is operable hydraulically and at a high speed.

BACKGROUND ART

It has long been recognized that a hydraulic press, operated under a fluid pressure, is advantageous over a mechanical press because of its greater ability to effect a freely changeable slide motion and hence to meet with a wide variety of pressing configuration requirements. On the other hand, a hydraulic press has been found to be disadvantageous because it is slow in motion and hence low in productivity as compared with a mechanical press.

Thus, it has hitherto been the common recognition that while a larger sized press system can mostly be constructed of a hydraulic press, a smaller sized press system may only be served by a mechanical press.

As the capability of producing articles of a greater variety but in a smaller volume is increasingly required in the recent years, there has a demand more and more developed for a small sized hydraulic press better possessing such a production capability and yet operable at a higher speed.

Accordingly, the art has seen various proposals designed to enable a hydraulic press to be operated at a high speed.

For example, Japanese Unexamined Patent Publication No. Hei 7-124797 proposes a hydraulic press system in which a hydraulic cylinder assembly is provided in a piston rod thereof with an inner chamber that has a prefill valve in fluid communication therewith and that may be supplied with a pressure fluid when a slide is to be displaced rapidly in order to enable the slide to accomplish a given displacement in a shorter period of time, thereby permitting it to move at a greater speed.

Also, Japanese Unexamined Patent Publication No. Hei 4-55099 (Examined Patent Publication No. Hei 7-22840) discloses a hydraulic press system which makes use of a first cylinder of a smaller diameter that is provided in a second cylinder of a larger diameter and that may be supplied with a pressure fluid during a die close time to close the dies and clamp them together quickly, thereby permitting a pressing operation to be accomplished at a high speed.

Also, Japanese Unexamined Utility Model Publication No. Hei 7-3898 may be noted, setting forth another hydraulic press system in which a hydraulic circuit for delivering a pressure fluid into a ram cylinder includes a circuit section whereby the ram can be allowed to descend rapidly, thus permitting the system to act at a higher speed.

It is noted, however, that all these prior hydraulic presses intended to operate at a high speed have a hydraulic cylinder and a control valve for its operation coupled together by pipe conduits for pressure fluid distribution and are each so constructed that a pressure fluid of which the flow rate is controlled by such a control valve may be supplied via such fluid distribution conduits into the hydraulic cylinder. As a result, a change in compressibility of fluid in the pressure fluid distribution pipe conduits may occur and the responsibility in operation of the hydraulic cylinder by the control valve may deteriorate, resulting in an inability to form with a due precision. And such construction may cause the presence of a fluid resistance in these pipe conduits to disable a large volume of the pressure fluid to be supplied within a short period of time into the hydraulic cylinder, thus giving rise to an inconvenience imposing a serious limitation on the attempt to make a system to operate at a high speed.

In addition, these prior art presses are found to be inconvenient on account of the poor capability they possess, that arises from the fact that the hydraulic cylinder has the pressure fluid distribution pipe conduits mounted therearound requiring the presence of a large space upwards of its body portion, to make it difficult to reduce the entire press machine size and requiring a remedial maintenance operation at a height when a leak of fluid arises at the pressure fluid distribution pipe conduits, to deteriorate the maintainability of them.

It is accordingly an object of the present invention to eliminate inconveniences and disadvantages met in the prior art as discussed above and to provide a hydraulic press that is truly operable at a high speed, superior in the responsibility and rapidity of an operation, better in maintenance and small sized.

SUMMARY OF THE INVENTION

In order to achieve the above mentioned object, there is provided in accordance with the present invention in a first form of embodiments thereof a high speed hydraulic press, having a press machine body that is constructed of a C-shaped frame, a high speed operable hydraulic cylinder assembly with a portion of the hydraulic cylinder disposed in an upper part of the press machine body, and a slide that is coupled to the hydraulic cylinder assembly and adapted to be moved thereby vertically up and down, which press comprises: a manifold block having a passage therein and mounted to the said hydraulic cylinder assembly directly on a front surface of the said cylinder; and a control valve means that is associated with the said manifold block for delivering a pressure fluid into the said hydraulic cylinder via the said passage in the said manifold block while controlling at least one of parameters of the said pressure fluid including flow rate and pressure thereof.

According to the construction described above, it can be noted and should be understood that delivering of a pressure fluid of which a parameter is controlled by a control valve means into the cylinder portion of a high speed operable hydraulic cylinder assembly may allow a large volume of the pressure fluid to be supplied into the said cylinder in a short period of time, thus permitting the press to be operated at an increased speed and yet with an enhanced responsibility.

Also, it can be noted and should be understood that the freedom of a pressure fluid in the manifold block from a change in its compressibility may increase an accuracy of positioning a press slide which is vertically moved up and down by the high speed operable hydraulic cylinder assembly, thereby enabling the press to be operated yielding an enhanced pressing precision.

In the construction mentioned above, it is desirable that the said manifold block be configured substantially in a form of bilateral symmetry and be mounted to the said high speed operable hydraulic cylinder assembly directly on the front surface of the said cylinder in a substantially central region thereof.

According to the construction described in the preceding paragraph, it can be seen and should be understood that since the said manifold block, being elevated in temperature during a pressing operation, is configured substantially in a form of bilateral symmetry and mounted to the high speed operable hydraulic cylinder assembly directly on the front surface of the hydraulic cylinder substantially in a central region thereof, there will be a markedly reduced unbalance in thermal expansion and contraction created bilaterally, thus minimizing the possible inaccuracy of a pressing operation due to a thermal effect.

Also, in the construction described above, it is preferred that a front cover be detachably mounted to the said press machine body on a upper front surface thereof, such as to cover both the said hydraulic cylinder and the said manifold block.

According to the construction described in the preceding paragraph, it can be seen and should be understood that covering both the said high speed operable hydraulic cylinder and the said manifold block in front thereof with a front cover may, if a fluid happens to leak, prevent a fluid of an elevated temperature from falling on the operator.

The present invention also provides in a second form of embodiments thereof a high speed hydraulic press, having a press machine body that is constructed of a C-shaped frame, a high speed operable hydraulic cylinder assembly with a portion of the hydraulic cylinder disposed in an upper part of the press machine body, and a slide that is coupled to the hydraulic cylinder assembly and adapted to be moved thereby vertically up and down, which press comprises: a hydraulic pressure generating means disposed in an upper rear side of the said press machine body for delivering a pressure fluid into the said hydraulic cylinder.

And, in the construction mentioned in the preceding paragraph, it is preferable that there be further provided a cooling means disposed above the said hydraulic pressure generating means for cooling the pressure fluid elevated in temperature.

According to the construction just described above, it can be seen and should be understood that a cooling means disposed above the said hydraulic pressure generating means may allow heat that is developed by the press itself and heat that is caused by the said hydraulic pressure generating means both to be emitted efficiently.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

BEST MODES FOR CARRYING OUT THE INVENTION

Hereinafter, suitable embodiments of the present invention with respect to a high speed hydraulic press will be set forth with reference to the accompanying drawings hereof.

An explanation will now be given with respect to a certain embodiment of high speed hydraulic press according to the present invention.

Figure 1:
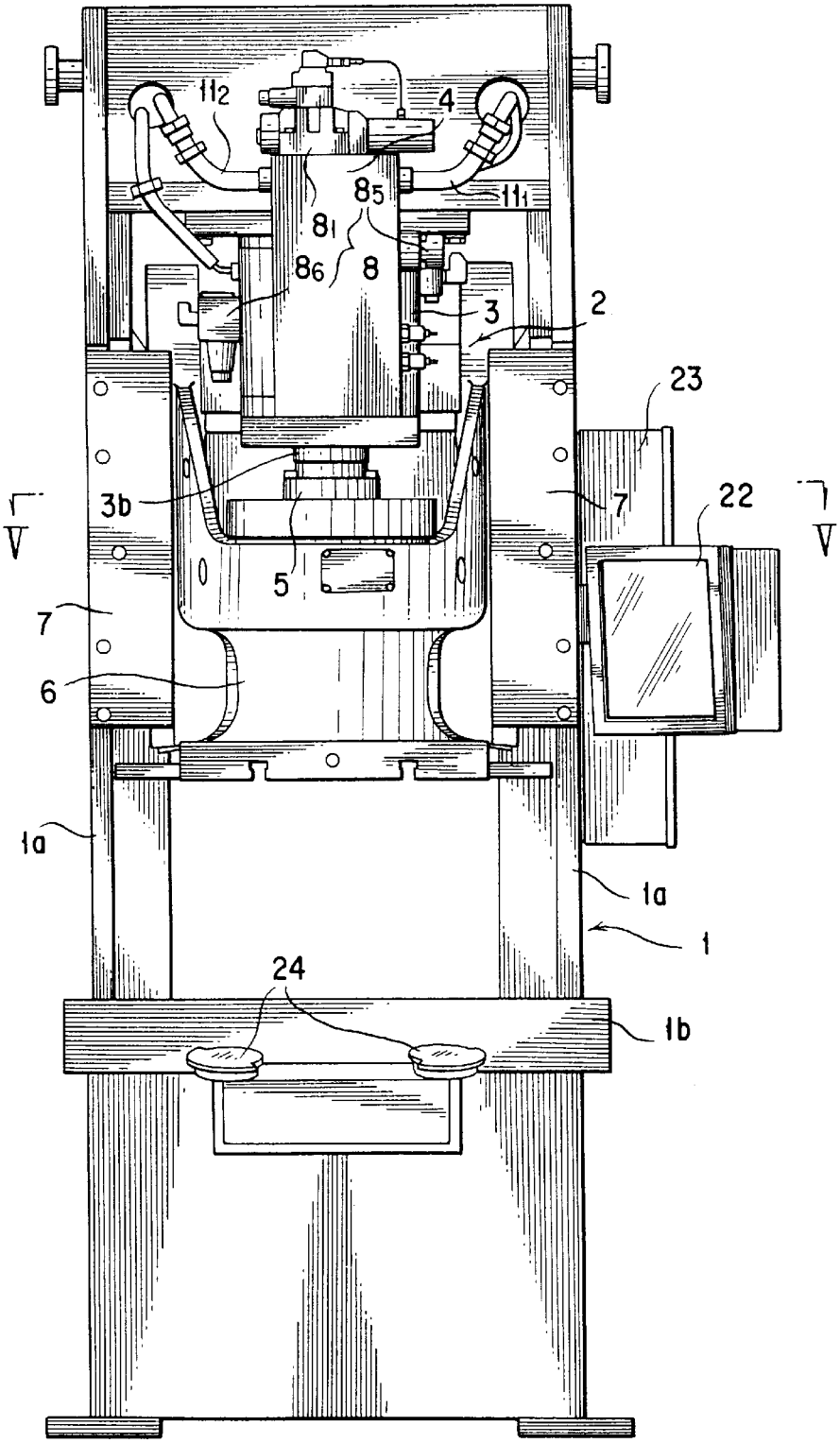
FIG. 1 is a front view that shows a hydraulic press which represents a certain embodiment of the present invention.
Figure 2:
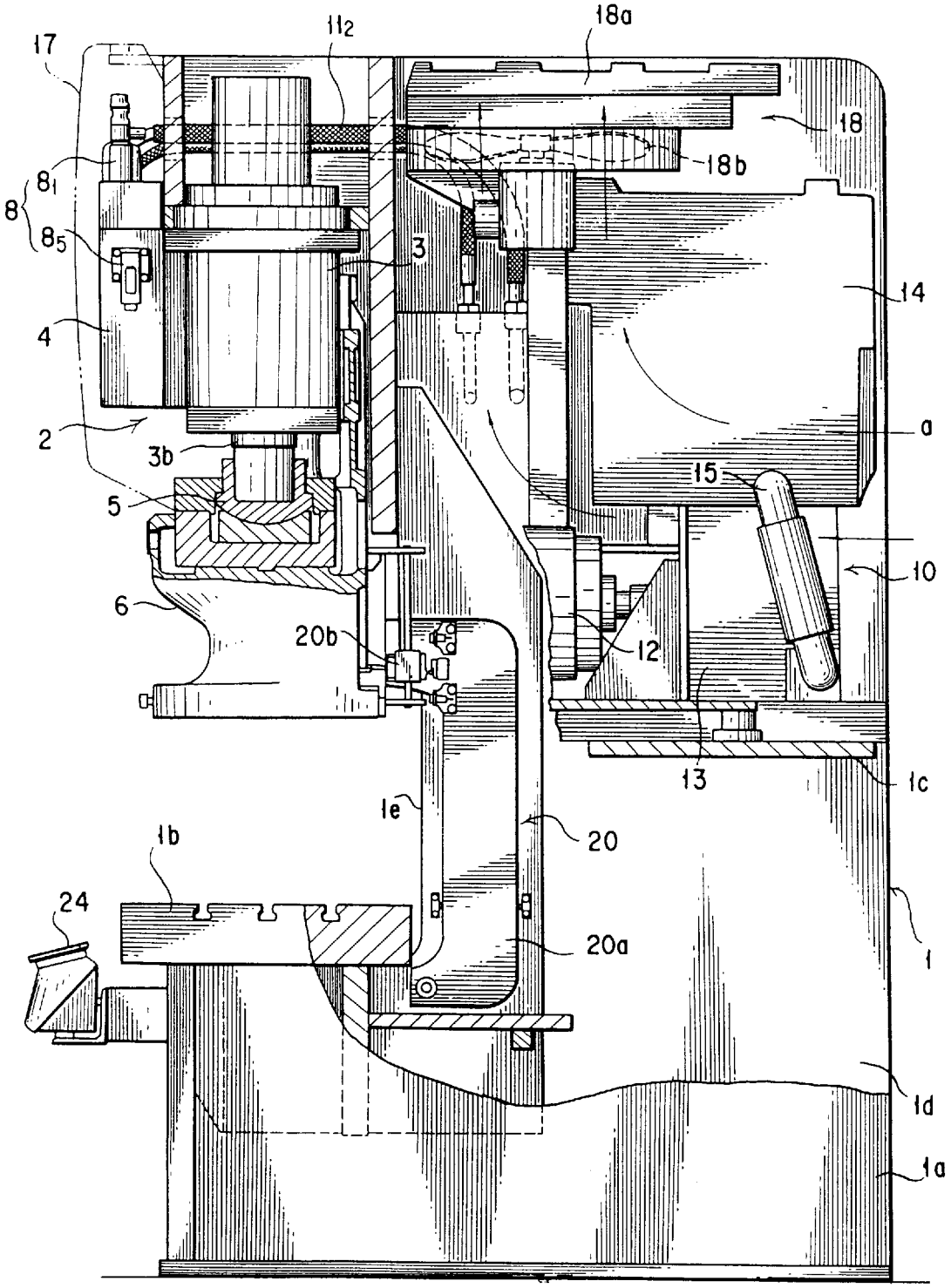
FIG. 2 is a side elevational view partly cut away that shows the above noted embodiment of the present invention.
Figure 3:
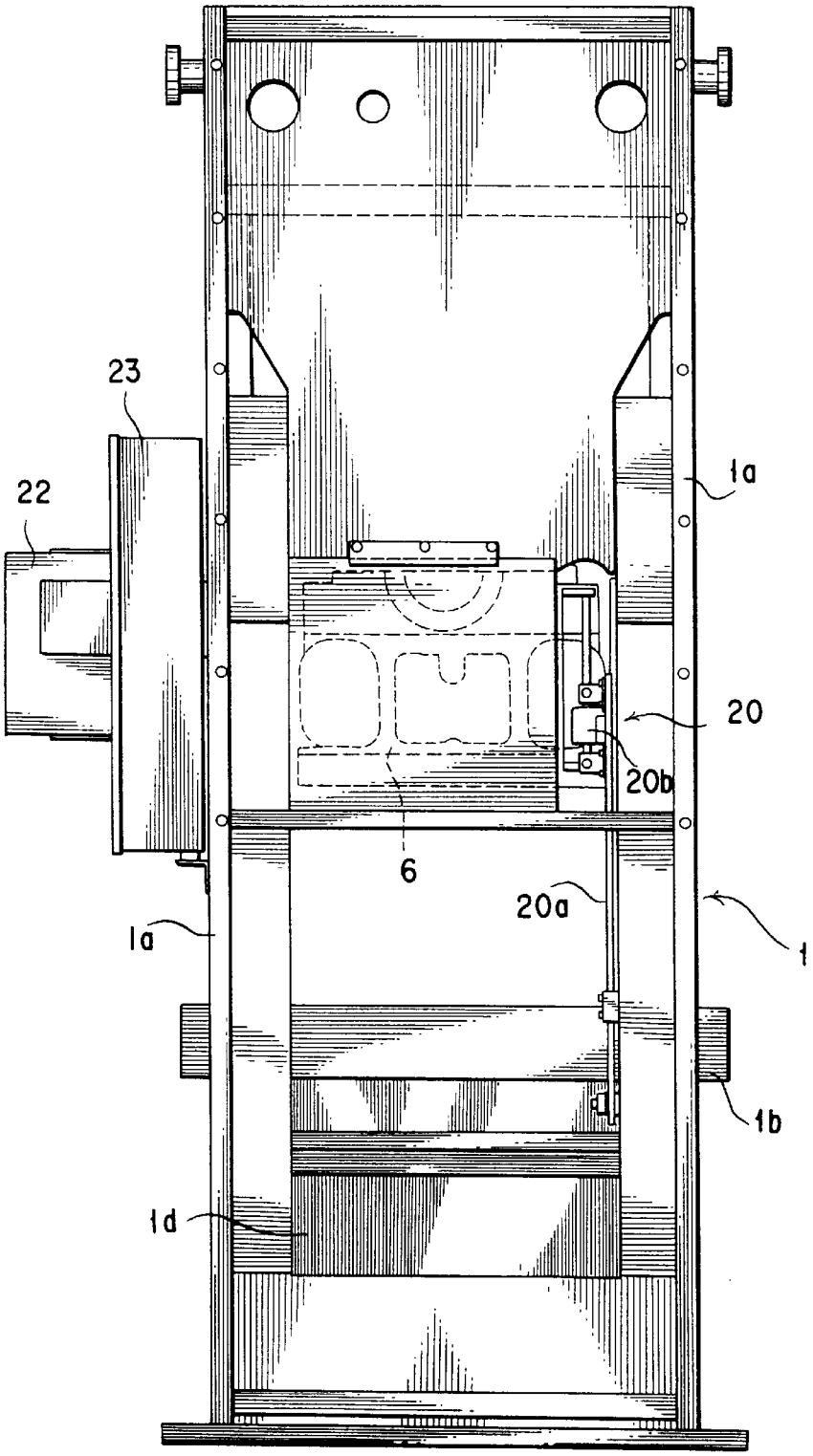
FIG. 3 is a rear elevational view that shows the above noted embodiment of the present invention.
Figure 4:
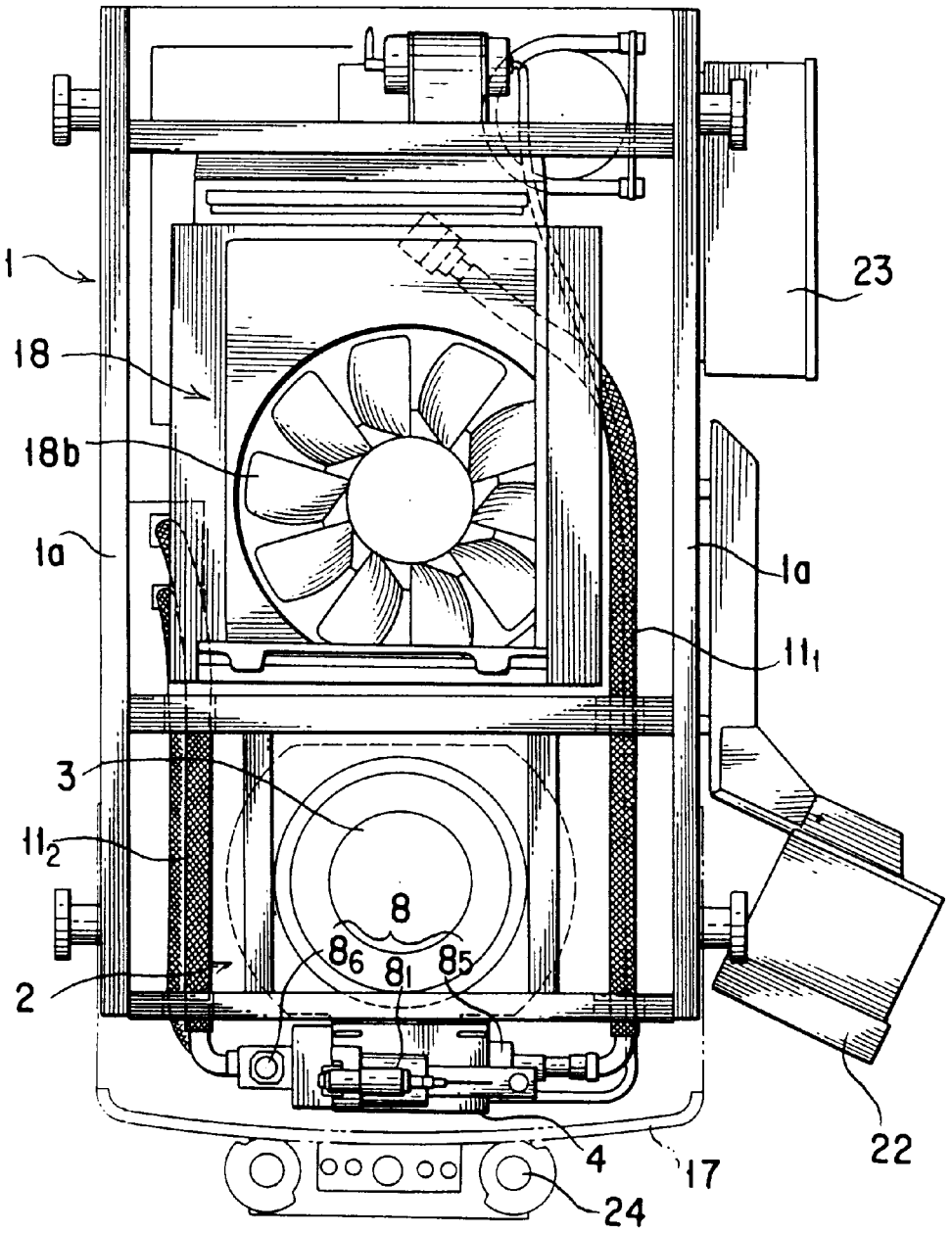
FIG. 4 is a top plan view partly omitted that shows the above noted embodiment of the present invention.
Figure 5:
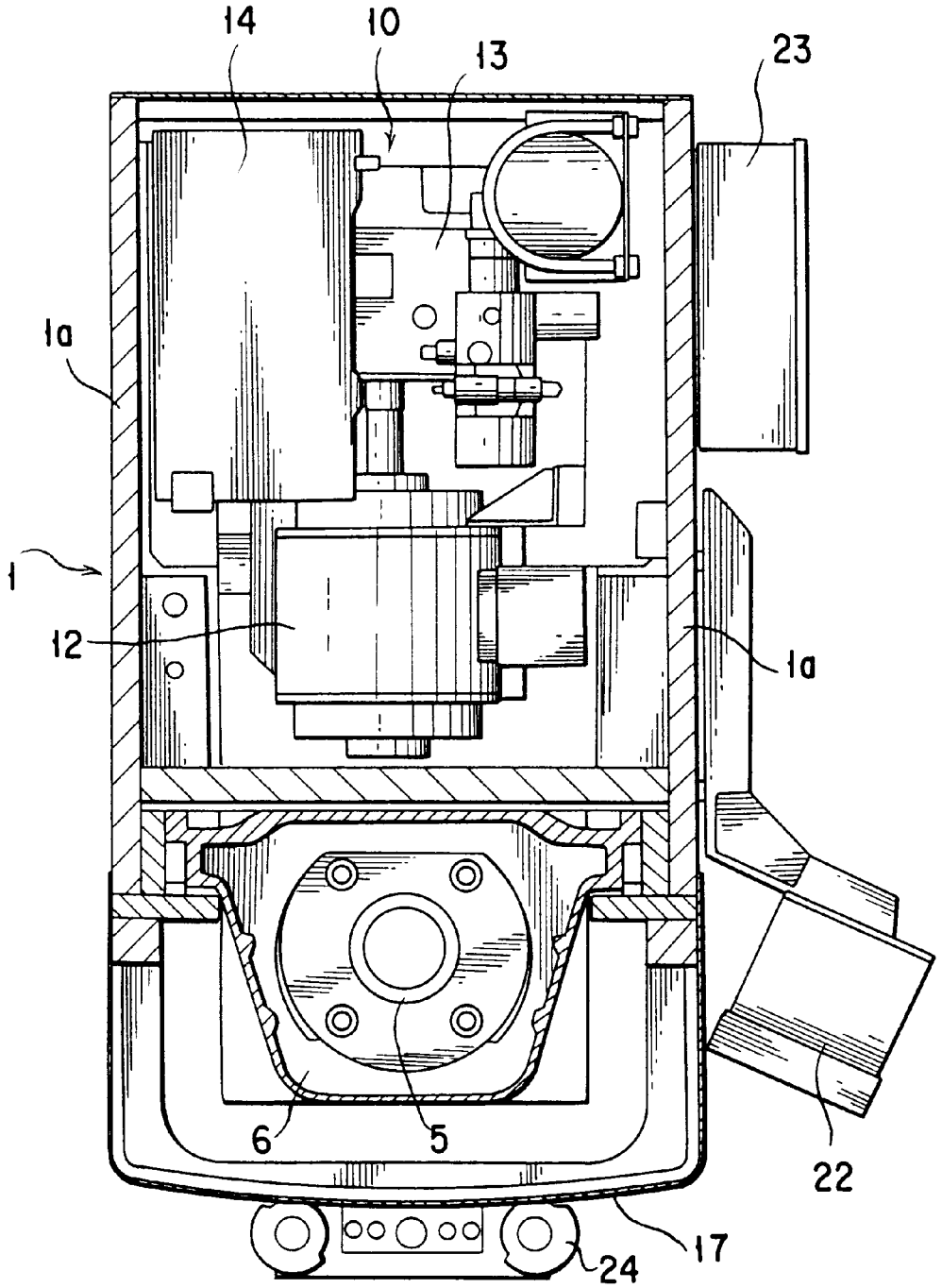
FIG. 5 is a cross sectional view taken along the line V—V in FIG. 1.
Figure 6:
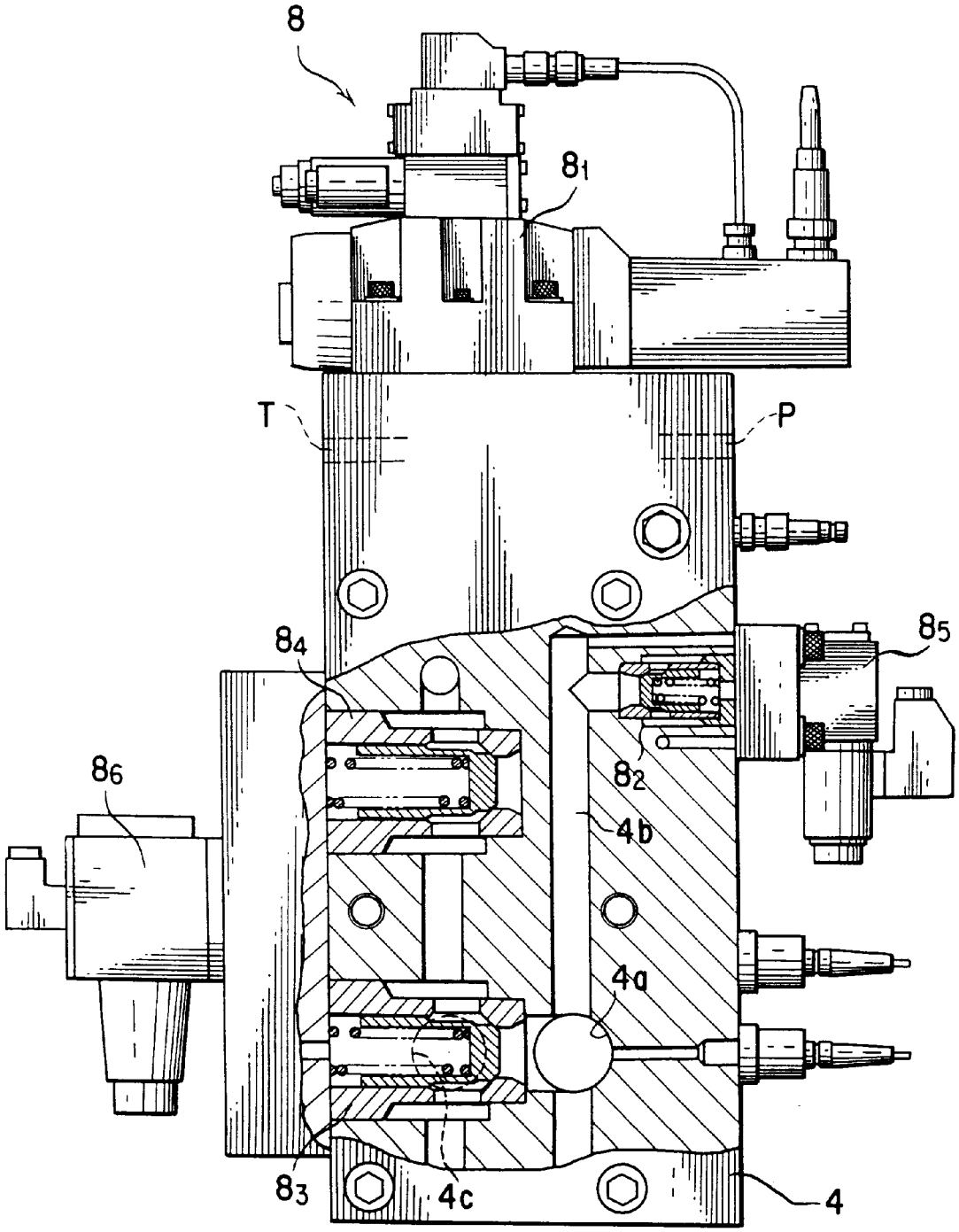
FIG. 6 is a front view partly cut away that shows a portion of a manifold block that can be provided in the above mentioned embodiment of the present invention.
Figure 7:
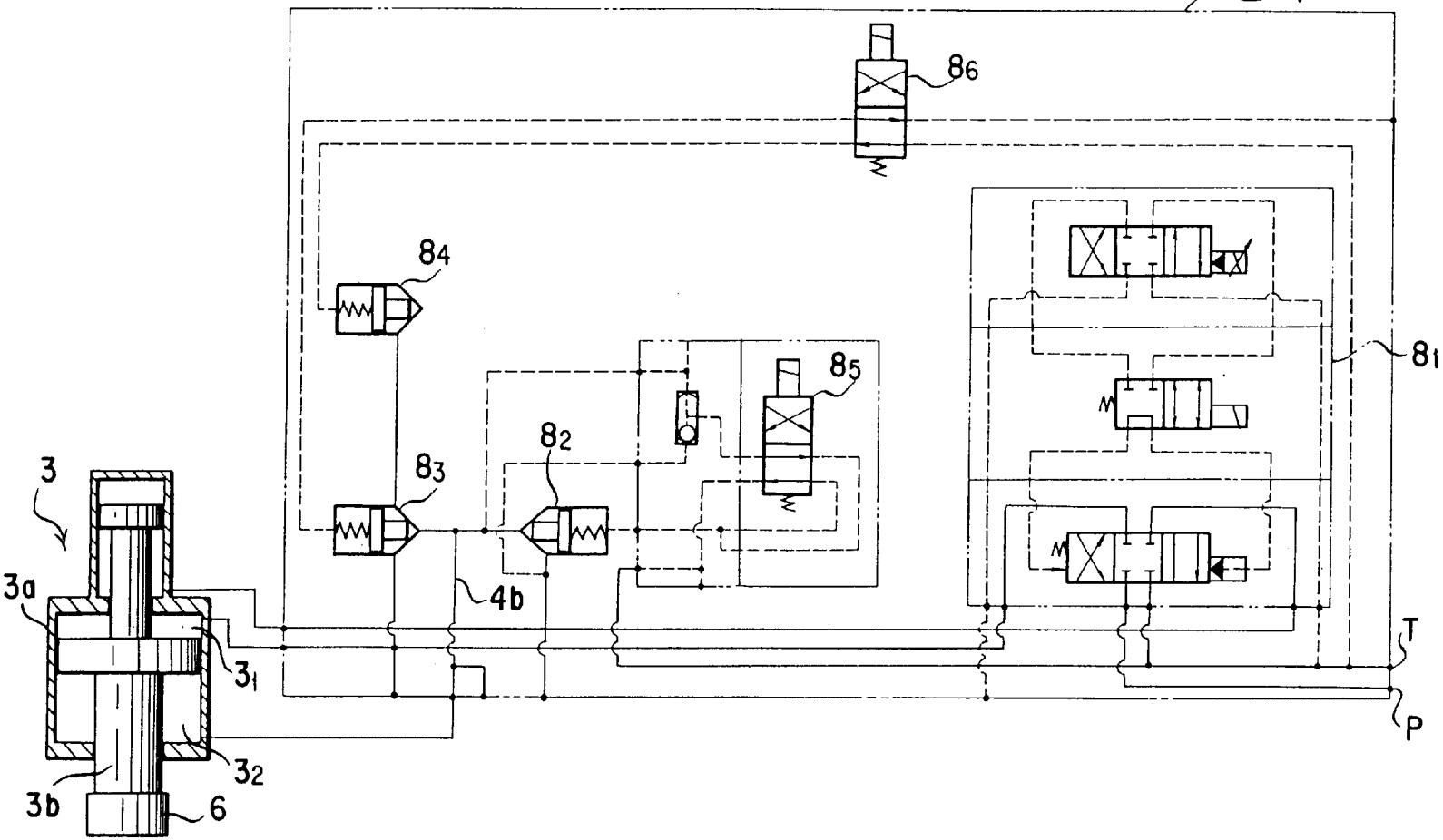
FIG. 7 is a circuit diagram that shows a hydraulic circuit for the manifold block and a high speed operable hydraulic cylinder assembly provided in the above described embodiment of the present invention.

FIG. 1 is a front view, FIG. 2 is a side elevational view partly cut away, FIG. 3 is a rear elevational view, FIG. 4 is a top plan view, and FIG. 5 is a cross sectional taken along the line V—V in FIG. 1, of the high speed hydraulic press, FIG. 6 is a front view partly cut away of the manifold block, and FIG. 7 shows a hydraulic circuit for connecting the manifold block with a high speed operable hydraulic cylinder assembly.

In these Figures, a press machine body 1 is shown as constructed of a C-shaped frame 1*a* and as comprising an upper part in which a hydraulic unit 2 is provided and a lower part in which a bolster 1*b* is located.

The hydraulic unit 2 comprises the high speed operable hydraulic cylinder assembly designated at 3 and the manifold block mounted to the hydraulic cylinder assembly 3 and attached to a portion of principal cylinder 3*a* on a front surface thereof.

A piston rod 3*b* is shown as projecting from the principal cylinder 3*a* of the high speed operable hydraulic cylinder assembly 3 and, as shown, has its lower end connected via a spherical point with a press slide 6.

The slide 6 is positioned upwards of the bolster 1*b* and has its two opposite sides guided as vertically slidable up and down on a pair of slide gibs 7 extended in a vertical direction and provided on the C-shaped frame 1*a*, and is adapted to be driven vertically up and down by the high speed hydraulic cylinder assembly 3.

The manifold block 4 indicated as mounted to the high speed hydraulic cylinder assembly 3 and attached in front thereof is, as seen from FIG. 1, located in an approximately central region of the cylinder assembly 3, and is attached thereto in a configuration of bilateral symmetry. And, the manifold block 4 has a control valve unit 8 mounted hereon.

The control valve unit 8 comprises a servo valve $\mathbf{8}_1$ that is disposed on or above the manifold block 4, a plurality of, for example, three logic valves $\mathbf{8}_2$, $\mathbf{8}_3$ and $\mathbf{8}_4$ which as shown in FIG. 6 are disposed within the manifold block 4, and a pair of electromagnetic valves $\mathbf{8}_5$ and $\mathbf{8}_6$ which are provided as attached to the manifold 4 at its two sides, respectively, for on-off controlling of the logic valves $\mathbf{8}_2$, $\mathbf{8}_3$ and $\mathbf{8}_4$.

Of all the logic valves $\mathbf{8}_2$, $\mathbf{8}_3$ and $\mathbf{8}_4$ disposed in the manifold block 4, the logic valves $\mathbf{8}_2$ and $\mathbf{8}_3$ are designed to switch over the pressure fluid that is supplied into the high speed operable hydraulic cylinder assembly 3, whereas the logic valve $\mathbf{8}_4$ is a pressure compensation valve that is designed to compensate for a variation in pressure that may be caused when the logic valve $\mathbf{8}_3$ is switched on and off. And, the logic valves $\mathbf{8}_2$ and $\mathbf{8}_3$ are connected to a passage 4*b* that is in fluid communication via a port 4*a* with the upper chamber $\mathbf{3}_1$ of the principal cylinder 3*a* which constitutes the high speed operable hydraulic cylinder assembly 3, and the logic valve 8*3* is disposed between a port 4*c* in fluid communication with the lower chamber $\mathbf{3}_2$ of the principal cylinder 3*a* and the above mentioned port 4*a*.

It should also be noted that the manifold block 4 is provided at two sides in its upper part with a pump port P and a tank port T, respectively, so that the pressure fluid supplied from the hydraulic pressure generating unit 10 may be allowed to flow into the servo valve $\mathbf{8}_1$ disposed on or above the manifold block 4 and may, after its flow rate and pressure having been controlled by the servo valve $\mathbf{8}_1$, be delivered via the logic valves $\mathbf{8}_2$ and $\mathbf{8}_3$ into the high speed hydraulic cylinder assembly 3.

Here, the manifold block 4 can be connected with the high speed operable cylinder assembly 3 in a hydraulic circuit as shown in FIG. 7.

It should also be noted that the passage 4*b* formed within the manifold block 4 and passage formed intermediate between the ports 4*a* and 4*b* are each configured to have a large diameter which are enough so that a large volume of pressure fluid may be allowed to flow therethrough in a short period of time.

On the other hand, it can be seen that the above mentioned hydraulic pressure generating unit 10 is disposed as positioned rearwards of the hydraulic unit 2 in an upper part of the press machine body 1.

More specifically, there is disposed vertically midway of the press machine body 1 in a rear part thereof a support member 1*c* that transversely extends across the left hand side and right hand side C-shaped frame sections 1*a* and there are mounted on this support member 1*c* an electric motor 12 and a hydraulic pump 13 to be rotationally driven thereby which together constitute the hydraulic pressure generating unit 10.

The hydraulic pump 13 has its suction side connected via a pipe conduit 15 with a fluid reservoir 14 and has its discharge side connected via a pipe conduit $\mathbf{11}_1$ with the pump port P in the manifold block 4, in which the tank port T is connected via a pipe conduit $\mathbf{11}_2$ with the fluid reservoir 14.

It should also be noted that the press machine body 1 has an upper front surface which as shown by the phantom lines in FIGS. 2 and 4 are covered with a front cover 17 so that either the hydraulic unit 2 or the manifold block 4 may not be exposed in front of the press machine body 1.

Also, there is mounted on an upper surface of the press machine body 1 a cooling unit 18 as positioned upwards of the hydraulic pressure generating unit 10.

The cooling unit 18 is designed to cool the fluid that is returned from the hydraulic unit 2 via the control valve unit 8 into the fluid reservoir 14, and is constructed of a fluid cooler 18*a* mounted at an upper surface opening section of the press machine body 1 and a cooling fan 18*b* disposed downwards of the fluid cooler 18*a* so that the cooling fan 18*b* blowing the air that has been sucked in a direction from the rear as shown by the arrows a in FIG. 2 towards the fluid cooler 18*a* can cool the fluid that is flowing therein.

Also, the press machine body 1 is formed in a lower rear part thereof with a vacant space id such as to permit a product transfer unit (not shown) to be accommodated therein for carrying out a pressed workpiece, and further has mounted in one of its C-shaped frame sections 1*a* a temperature compensation unit 20.

The temperature compensation unit 20 includes a support member 20*a* attached to the C-shaped frame 1*a* along a C-shaped opening portion 1*e* and having its lower end that is pivotally attached to the C-shaped frame 1*a*.

The support member 20*a* has its upper end provided with a displacement sensor 20*b* for detecting an expansion and contraction of the C-shaped frame 1*a* in response to a temperature thereof and for providing a thermal displacement signal detected thereby that is then furnished to a control unit (not shown) so as to effect a compensation for the thermal expansion and contraction sensed of the press machine body 1.

In FIGS. 1, 4 and 5 there are also shown a control panel 22, a control box 23 and a set of operating push buttons 24.

Next, an explanation will be given with respect to an operation of the hydraulic press which is constructed as so far described.

In a pressing operation, it should be noted that first an upper die will be secured to the lower surface of the slide 6 and a lower die will be securely mounted on the bolster 1*b* (the dies not shown) to commence the operation. Then, depressing of the operating buttons 24 will cause the hydraulic pressure generating unit 10 to deliver a pressure fluid of an elevated pressure from the pipe conduit $\mathbf{11}_1$ via the pump port P to the servo valve $\mathbf{8}_1$ and thence the pressure fluid with its flow rate controlled at the servo valve $\mathbf{8}_1$ to be supplied through the passage 4*b* within the manifold block 4 and the logic valves $\mathbf{8}_2$ and $\mathbf{8}_3$ for delivery into the upper chamber $\mathbf{3}_1$ of the principal cylinder 3*a* of the high pressure operable hydraulic cylinder assembly 3.

At this point of time, it should be noted that by virtue of the fact that the passage between the ports 4*a* and 4*c* within the manifold block 4 is formed as having a large diameter enough to allow a large volume of the pressure fluid to flow therethrough and that the manifold block 4 is mounted directly to the high pressure operable hydraulic cylinder assembly 3, the pressure fluid having its flow rate controlled by the servo valve $\mathbf{8}_1$ will instantaneously be delivered into the cylinder assembly 3, thereby to allow the latter to operate at an enhanced responsibility. Also, with the manifold block 4 being formed of a rigid body, there may be no change brought about in compressibility of the fluid therein. Thus, the pressure fluid with its flow rate controlled by the servo valve $\mathbf{8}_1$ will then permit the slide 6 to descend in a predetermined motion at an enhanced accuracy.

Also, the above mentioned operation permitting the descending position of the slide 6 to be determined at an increased accuracy will enable a desired press forming process to be performed between the upper die secured to the slide 6 and the lower die securely mounted on the bolster 1*b* at an enhanced precision.

It should also be noted that when the slide 6 has been lowered down to its lower dead point to complete a desired press forming operation, the logic valves $\mathbf{8}_2$ and $\mathbf{8}_3$ will be switched over by the electromagnetic valves $\mathbf{8}_5$ and $\mathbf{8}_6$, respectively, to allow the pressure fluid to be delivered into the lower chamber $\mathbf{3}_2$ of the principal cylinder 3*a* of the high pressure hydraulic cylinder assembly 3. Then, the slide 6 will be raised rapidly up to its upper dead point and will thereafter stand by for a next pressing operation.

On the other hand, the fluid raised in temperature during the pressing operation will, on the way it flows towards the fluid reservoir 14 via the pipe conduit $\mathbf{11}_2$ through the cooling unit 18, be cooled within the cooling unit 18 disposed midway thereof.

The cooling unit 18, that is designed to take in air from the rear of the hydraulic pressure generating unit 10 that is disposed in an upper rear part of the press machine body 1 and to blow by means of the cooling fan 18*b* the sucked air towards the fluid cooler 18*a* that is disposed on an upper surface of the press machine body 1, will cool the fluid flowing in the fluid cooler 18*a*, thus allowing the fluid raised in temperature to be cooled efficiently. And, with both the hydraulic unit 2 and the hydraulic pressure generating unit 10 which are each a heat build-up source being each concentrated on an upper part of the press machine unit 1 in a location thereof that is spaced from the temperature compensation unit 20, the latter may not have an influence received from the former two, thus permitting a compensation for a thermal expansion and contraction of the press machine body 1 to be achieved with a due precision.

It will also be apparent that locating the hydraulic pressure generating unit 10 in an upper rear part of the press machine body 1 will allow the space 1*d* in a lower rear part thereof to be secured widely. Then, by locating in the space 1*d* a product transfer unit for carrying out a press formed workpiece and so forth, workpieces can be smoothly conveyed into and out of the press machine body 1.

As set forth in the foregoing description, it can be seen and should be understood, therefore, that the present invention has provided an improved hydraulic press in which a pressure fluid that is supplied from a hydraulic pressure generating unit is fed through a control valve unit that is associated with a manifold block directly mounted to a high pressure operable hydraulic cylinder for delivery into the latter. As has been noted, this provision allows the pressure fluid in a large volume to flow into the hydraulic cylinder in a short period of time, thus permitting the hydraulic press to be operated at an increased speed, hence the productivity is markedly enhanced. And, owing also to a reduced resistance encountered in flow paths, an operation thereof with energy significantly saved is performed.

It may also be noted that by virtue of delivery via a passage within the manifold block into the high speed operable hydraulic cylinder assembly of a pressure fluid of which the flow rate is controlled by the control valve unit, the hydraulic press will be afforded with an enhanced responsibility in operation. Further, with there being no change in compressibility of the pressure fluid developed midway in the fluid path, the slide can be controlledly positioned at a high precision by means of a valve unit as mentioned above, thus permitting the hydraulic press to perform a desired forming operation with an enhanced accuracy.

It can further be noted that locating the hydraulic pressure generating unit in an upper rear part of the press machine body will allow a wide space to be secured in a lower rear part thereof. Then, by locating in that space a product transfer unit for carrying out a press formed workpiece and so forth, workpieces can be conveyed smoothly into and out of the press machine body. This affords a further increased productivity to the hydraulic press that is operable at an increased speed.

It may further be seen that configuring of the manifold block having the control valve unit associated therewith in a form of bilateral symmetry and being directly mounted to the high speed operable hydraulic cylinder in front thereof will allow a particular piping design between the control valve unit and the cylinder unnecessary and hence allow the hydraulic unit to be made compact with no fluid leakage from a pipe conduit and will allow the manifold block to be detached, to permit maintenance work for a high pressure circuit associated with the high speed hydraulic cylinder assembly, thereby enhancing the maintainability of a high speed operable hydraulic press of the present invention.

Yet, it should be noted that covering an upper front surface of the press machine body with a front cover to prevent the press front surface from being exposed will not only improved the appearance of the hydraulic press but also will, should a fluid leakage even happen in the hydraulic unit, prevent a high temperature fluid from falling on the operator, thus ensuring the operator's safety.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A high speed hydraulic press, having a press machine body that is constructed of a C-shaped frame, a high speed operable hydraulic cylinder assembly with a portion of the hydraulic cylinder disposed in an upper part of the press machine body, and a slide that is coupled to the hydraulic cylinder assembly and adapted to be moved thereby vertically up and down, the press comprising:

a manifold block having a passage therein and mounted to said hydraulic cylinder assembly directly on a front surface of said cylinder; and a control valve means that is associated with said manifold block for delivering a pressure fluid into said hydraulic cylinder via said passage in said manifold block while controlling at least one of parameters of said pressure fluid including flow rate and pressure thereof.

2. A high speed hydraulic press as set forth in claim 1, in which said manifold block is configured in a form of bilateral symmetry, and mounted to said hydraulic cylinder assembly directly on the front surface of said cylinder in a substantially central region thereof.

3. A high speed hydraulic press as set forth in claim 2 in which a front cover is detachably mounted to said press machine body on an upper front surface thereof, such as to cover both said hydraulic cylinder and said manifold block.

4. A high speed hydraulic press as set forth in claim 1 in which a front cover is detachably mounted to said press machine body on an upper front surface thereof, such as to cover both said hydraulic cylinder and said manifold block.

5. A high speed hydraulic press, having a press machine body that is constructed of a C-shaped frame, a high speed operable hydraulic cylinder assembly with a portion of the hydraulic cylinder disposed in an upper part of the press machine body, and a slide that is coupled to the hydraulic cylinder assembly and adapted to be moved thereby vertically up and down, the press comprising:

a support member disposed vertically intermediate of said press machine body in a rear part thereof and extending transversely across a left hand side and a right hand side C-shaped frame section; and a hydraulic pressure generating means disposed on said support member for delivering a pressure fluid into said hydraulic cylinder.

6. A high speed hydraulic press as set forth in claim 5, further comprising a cooling means disposed above said hydraulic pressure generating means for cooling the pressure fluid elevated in temperature.

* * * * *